US007036814B2

(12) United States Patent
Oh et al.

(10) Patent No.: US 7,036,814 B2
(45) Date of Patent: May 2, 2006

(54) PASSIVE MEDIA SEPARATING DEVICE

(75) Inventors: Hieyoung W. Oh, Bowdoin, ME (US); Jeffrey W. Richarson, Otisfield, ME (US)

(73) Assignee: Illinois Tool Works Inc, Glenview, IL (US)

( * ) Notice: Subject to any disclaimer, the term of this patent is extended or adjusted under 35 U.S.C. 154(b) by 171 days.

(21) Appl. No.: 10/454,180

(22) Filed: Jun. 4, 2003

(65) Prior Publication Data

US 2004/0032077 A1 Feb. 19, 2004

Related U.S. Application Data

(60) Provisional application No. 60/403,931, filed on Aug. 16, 2002.

(51) Int. Cl.
*B65H 3/52* (2006.01)

(52) U.S. Cl. ..... 271/121; 271/167

(58) Field of Classification Search ..... 271/276, 271/196, 197, 121, 124, 167, 104, 137, 162; 101/419, 448; 400/579, 582
See application file for complete search history.

(56) References Cited

U.S. PATENT DOCUMENTS

| | | | | |
|---|---|---|---|---|
| 4,541,623 | A | 9/1985 | Huerta | 271/10 |
| 5,560,597 | A * | 10/1996 | Bailey et al. | 271/145 |
| 5,660,384 | A | 8/1997 | Kovach et al. | 271/145 |
| 5,895,040 | A * | 4/1999 | Oleksa et al. | 271/124 |
| 6,139,007 | A | 10/2000 | Cahill et al. | 271/121 |
| 6,502,816 | B1 * | 1/2003 | Inoue et al. | 271/121 |
| 6,536,757 | B1 * | 3/2003 | Chang | 271/16 |
| 2001/0040335 | A1 | 11/2001 | Chang | 271/21 |
| 2002/0008348 | A1 * | 1/2002 | Inoue et al. | 271/10.11 |
| 2002/0060396 | A1 | 5/2002 | Tanaka | 271/121 |
| 2002/0163117 | A1 | 11/2002 | Hsieh | 271/121 |

FOREIGN PATENT DOCUMENTS

EP 1 125 873 A1 8/2001

* cited by examiner

*Primary Examiner*—Kathy Matecki
*Assistant Examiner*—Thomas Morrison
(74) *Attorney, Agent, or Firm*—Paul F. Donovan; Mark W. Croll

(57) ABSTRACT

A media separator includes an elongated body having a series of formations thereon. The formations have angular surfaces for engaging a leading edge of sheets advancing therealong. As the leading edges move against the formations, separation between the sheets is enhanced.

26 Claims, 5 Drawing Sheets

PASSIVE MEDIA SEPARATING DEVICE

CROSS REFERENCE TO RELATED APPLICATIONS

This application claims benefit of U.S. Provisional Application No. 60/403,931, filed Aug. 16, 2002.

FIELD OF THE INVENTION

The present invention relates to media handling devices such as printers, copiers, fax machines and the like, and, more particularly, the present invention relates to media separating devices used in the feed mechanisms for such machines.

BACKGROUND OF THE INVENTION

Printers, copiers, fax machines, scanners and the like use a variety of different pick mechanisms to deliver individual sheets of media to a delivery or indexing system. It is known to provide a stack of media in a tray, which may be vertical, horizontal or at some angle therebetween, and to feed individual sheets from the stack to the device. For trouble free operation of the device, it is necessary that only a single sheet be fed at a time. Thus, the pick mechanism and sheet feed structure must include some means for individualizing or separating a single sheet from the stack of sheets. In very high-speed devices that are often costly, it is known to use sheet feeders having relatively complex mechanical mechanisms for separating the individual sheets. However, there is a need also for lower cost printers, copiers, fax machines and the like. These machines must also separate and feed media reliably, but with less expensive and less complicated mechanisms. Therefore, simple, reliable, inexpensive sheet separating devices are required.

Passive separation devices are known to have a slanted rubber element against which an advancing piece of media is driven. The media is driven from the top of a stack of media by a spring-biased feeding wheel. Separation occurs from the friction of the advancing media edge against the rubber surface. The angle of the rubber surface in relation to the advancing media and the frictional coefficient of the rubber impact the performance of such devices. If the media stack is large, the stack covers much of the rubber surface, and the exposed distance over which separation can occur is small. Further, the feed wheel rides on top of the media stack, biased thereagainst by a spring. When the media stack is tall, the spring force exerted against the stack through the drive wheel is large and friction between sheets is high. Coupled with the short separation distance available, these conditions can lead to double feeding. Conversely, when the media stack is short, the spring force against the stack is lower, and may be inadequate to empty the media tray if the spring is adjusted to eliminate potential double feeding from a tall media stack. Further problems are experienced if the stack of media is positioned too closely to the rubber surface. Double feeding and jamming can result if the stack of media is forced against the rubber surface.

Designing a simple but effective separating device is complicated by several factors. As mentioned previously, sheet feed devices can be horizontal, vertical or at some angle between horizontal and vertical. Further, it is common and desirable for the devices such as printers, copiers and fax machines to process a variety of different materials. For example, a printer may routinely handle relatively light-weight, draft grade papers, heavier weight bond papers, card stock, transparencies and envelopes. To simplify the device and reduce cost, while also reducing the chance for mechanical failure, it is desirable that many functions of the machine be relatively passive, that is, the function performed with minimal mechanical movement or operation.

While known separating devices have functioned satisfactorily to some extent, as speeds increase more definite reliable separation is required. Further, it is desirable that the separating device function consistently with different types of media, from the top piece of media in a stack to the bottom piece of media in the stack.

SUMMARY OF THE INVENTION

The present invention provides a passive media-separating device having a formed surface to separate and maintain separation between individual media fed from a stack of media.

In one form thereof, the present invention provides a media-separating device for a media feeder in a media-processing device wherein individual pieces of media are picked from a stack of media and advanced for individual handing in the media-processing device. The separating device has a separator with a surface thereof disposed in a substantially confronting position relative to the stack of media, to confront the leading edges of pieces of media removed the stack. An array of formations is provided on the surface of the separator. Each formation includes a blocking surface positioned for confronting the leading edges of the moving media, a passing surface in a substantially non-confronting position relative to the leading edges of the media, and an apex at a connection between the blocking and passing surfaces. The apex is positioned relative to the passing surface and the movement of the leading edges for directing the leading edges over the passing surface. The array provides a succession of the formations along a path of travel by the leading edges of media removed from the stack. Means are provided for driving pieces of media from the stack against the separator.

In another form thereof, the present invention provides a media feeder for a media processing device with a media tray for holding a stack of media, a feeding mechanism for moving a first piece of media from the stack toward a discharge point and a media separating device. The media separating device includes a surface facing leading edges of media in a stack of media held in the tray. The surface includes a series of surface formations. Each formation includes a blocking surface positioned for confronting the leading edges of the moving media, a passing surface in a substantially non-confronting position relative to the leading edges of the media and an apex at a connection between the blocking and passing surfaces. The apex is positioned relative to the passing surface and the movement of the leading edges for directing the leading edges over the passing surface.

In still another form thereof, the present invention provides a media separating device assembly for a media feeder. The assembly has a separator holder including a panel defining a slot; sides on opposite edges of the panel and blocks on a surface of the panel. The blocks are disposed on opposite sides of the slot near one end of the slot. Each block has an angular surface angling from one of the sides inwardly toward the slot and outwardly toward the one end. A separator component is slidable relative to the panel between the sides. The separator component includes an elongated separator have an array of formations thereon. The separator is positioned in the slot with the formations projecting beyond an opposite surface of the panel. Arms connected to the separator extend along and spaced from the separator. Tips of the arms engage the angular surfaces of the blocks.

An advantage of the present invention is providing a passive media-separating device that is simple, inexpensive, easily installed, and consistent in performance.

Another advantage of the present invention is providing a media-separating device that works effectively on a wide range of media types, including heavier and lighter weight media.

A further advantage of the present invention is providing a media-separating device that provides a barricade against improper loading of a paper tray.

Yet another advantage of the present invention is providing a media-separating device that works effectively on all pieces of media in a stack, from the top pieces in a full media tray to the bottom pieces in the media tray.

Still another advantage of the present invention is providing a media-separating device that works effectively on a variety of media feeders, including both horizontal feeders and vertical feeders.

Other features and advantages of the invention will become apparent to those skilled in the art upon review of the following detailed description, claims and drawings in which like numerals are used to designate like features.

Figure 1:
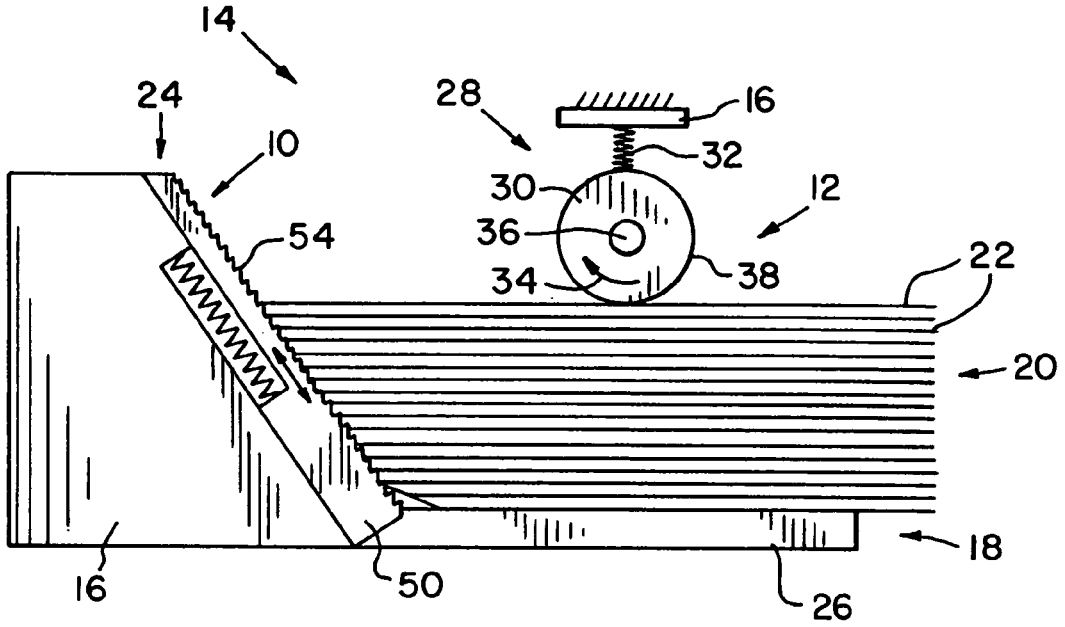
FIG. 1 is an elevational view of a horizontal media feeder having a passive media separating device in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including" and "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a passive media separating device 10 in accordance with the present invention is shown in a media feeder 12 of a media-processing device 14 including frame members 16. Media processing device 14 can be a printer, copier, fax machine, scanner or other machine in which media is processed individually in some manner. In that regard, media feeder 12 can be provided for feeding clean pieces of media such as paper of various weights, envelopes, card stock, transparencies, or the like for receiving printing thereon in a printer, fax machine, copier, etc. Alternatively, media feeder 12 can be provided for feeding original documents to be scanned, copied, faxed or the like. Media separating device 10 works well for many applications in which media of some type is removed from a media stack and fed individually for further processing.

Media feeder 12 illustrated in FIG. 1 is a horizontal feeder having a horizontal media tray 18, which may be integral with frame 16, or removable from frame members 16. A media stack 20 including a plurality of individual pieces of media 22 is placed in media tray 18, and individual pieces of media 22 are removed, one by one, from media stack 20 for use in downstream functions (not shown) of media processing device 14.

Media tray 18 has a discharge end 24 at which separating device 10 of the present invention is positioned, to operate on individual pieces of media 22 to cause separation thereof from stack 20. Media tray 18 has a substantially horizontal, fixed position bottom 26. Media tray 18 also includes side positioning means (not shown) for media stack 20, as those skilled in the art will understand readily.

Media feeder 12 further includes a feeding mechanism 28 including a feeding roll 30 that operates against the top piece of media 22 in media stack 20. Feeding roll 30 is directly or indirectly secured to one of the frame members 16, and is biased by a spring 32 against stack 20. Feeding roll 30 is rotatably driven by drive means (not shown) to rotate in the direction indicated by arrow 34 about an axis 36. Feeding roll 30 is provided with a peripheral surface 38 of rubber, plastic or other material to create sufficient friction between roll 30 and media 22 so that rotation of roll 30 drives the top piece of media 22 toward discharge end 24 of media tray 18. Those skilled in the art will understand that feeding mechanism 28 can be of other designs than that shown, which is only exemplary and not limiting of the present invention. The present invention can be used on media feeders of various types, including different feeding mechanisms.

Figure 2:
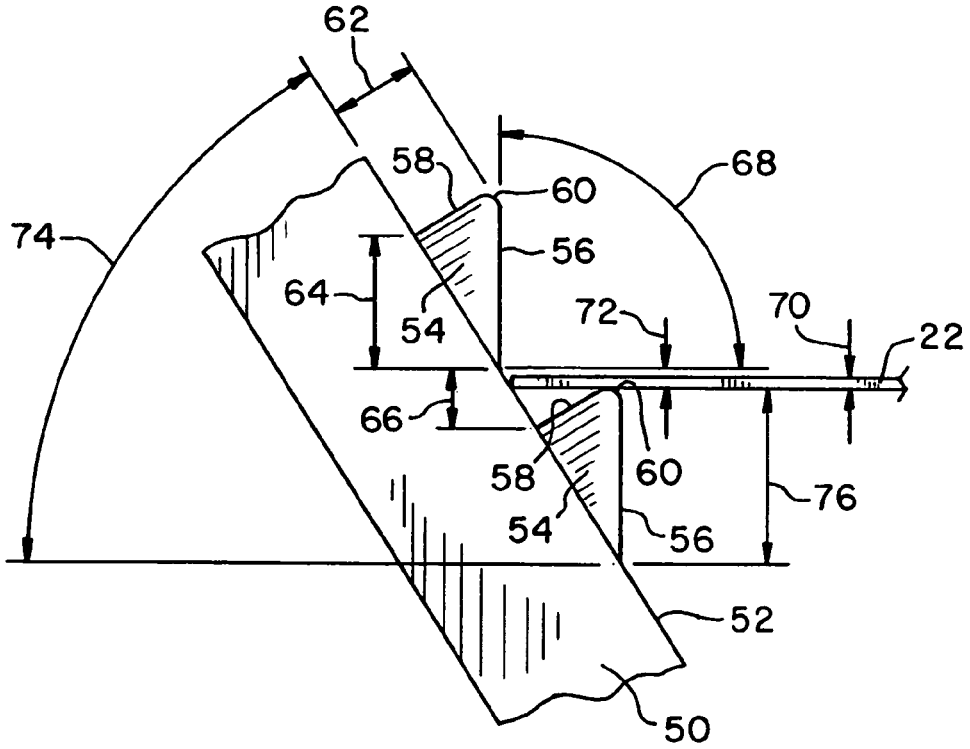
FIG. 2 is an enlarged view of a portion of a media separator in the separating device of the present invention.

A first embodiment of the present invention is shown in FIGS. 1 and 2.

Media separating device 10 includes a separator 50 mounted in media tray 18 at discharge end 24. Separator 50 is disposed at an outwardly reclining angle with respect to tray bottom 26, and has a surface 52 facing media stack 20. Surface 52 has an array of formations 54 thereon which engage media 22 to cause separation of individual pieces of media 22 from media stack 20. Formations 54 provide a series of surface segments of distinctly different slopes, and operate with segments of surface 52 between adjacent formations 54 to control bending or deflection of each piece of media 22 as it is driven thereagainst by feeding mechanism 28.

With reference now to FIG. 2, an enlarged portion of separator 50 is shown, with two formations 54 shown on a portion of surface 52 thereof. Formations 54 are spaced from each other along surface 52, with an exposed segment of surface 52 between adjacent formations 54. Formations 54 are generally triangular shaped bodies projecting from surface 52 toward media stack 20. Each formation 54 presents a substantially blunt or blocking surface 56 facing toward and confronting media stack 20. Blocking surface 56 inhibits or blocks forward moving pieces of media 22. Each formation 54 further includes a passing surface 58 positioned in a non-confronting orientation to advancing media 22. Passing surface 58 provides little or no hindrance to forward moving pieces of media 22. A curved apex 60 connects surfaces 56 and 58.

FIG. 2 further illustrates some dimensional interrelationships for separator 50 that have been found to provide good performance with a range of standard types of media 22 commonly used. Arrowed line 62 represents the greatest dimension of formation 54 from surface 52, preferably between about 0.15 mm and 0.75 mm. Segmented arrowed line 64 represents the vertical height of formation 54 between the points at which surfaces 56 and 58 are connected to surface 52, which height is preferably between about 0.5 mm and 1.5 mm. Arrowed line 66 represents the vertical distance between the points at which adjacent formations 54 are connected to surface 52, such distance preferably being between about 0.1 mm and 0.5 mm. Segmented curved line 68 represents the angle between blocking surface 56 and a piece of media 22 passing over apex 60 and against the lowermost edge of blocking surface 56, the angle preferably being between about 60 degrees and 135 degrees. Opposed arrows 70 represent the thickness of media 22, and opposed arrows 72 represent the vertical distance between apex 60 of one formation 54 and the point at which blocking surface 56 is joined to surface 52. Preferably, the distance represented by opposed arrows 72 is greater than the distance represented by opposed arrows 70. Segmented curved line 74 designates the incline angle of surface 52 from the plane of tray bottom 26. Oppositely directed arrowed lines 76 designate the length of blocking surface 56. Through testing, the preferred length of blocking surface 56 represented by arrowed lines 76 appears to be related to the incline angle of surface 52, represented by segmented curved line 74, although no direct mathematical relationship has been determined. Generally, the length of blocking surface 56 represented by arrowed lines 76 is longer for shallower angles of inclination represented by segmented curved line 74, and can be shorter for steeper angles of inclination represented by segmented curved line 74.

In the use of media feeder 12 having media separating device 10, feeding mechanism 28 is operatively engaged against the uppermost sheet of media 22 in media stack 20. Rotation of feeding roll 30 causes one or several sheets of media 22 to move toward discharge end 24 of tray 18. A leading edge of each advancing piece of media 22 abuts against surface 52 or blocking surface 56, causing upward deflection of leading edge. Continued advancement of media 22 causes leading edge to slide against segments of surface 52 between adjacent formations 54, and along blocking surfaces 56 of successive formations 54. An uppermost piece of media 22 eventually slides over apex 60 of one formation 54, with directs media 22 to slide rapidly over passing surface 58 of the same formation 54 to abut against surface 52 or a next formation 54 immediately thereabove. At the same time, any piece of media 22 below the upper most media 22 is delayed slightly as the leading edge continues to engage blocking surface 56 of the lower formation 54. A shingling effect occurs between all adjacent pieces of media 22, with an uppermost piece of media 22 of each adjacent pair of media 22 advancing beyond the lower piece of the pair. Such shingling effect increases as pieces of media 22 advance from formation 54 to formation 54 along separator 50. Eventually, the top piece of media 22 advances over an uppermost formation 54 of separator 20, and is grasped by media handling structures (not shown) outside of tray 18. At this point the top piece of media 22 has been separated sufficiently from any and all pieces of media 22 below it so that only the single uppermost piece of media 22 is removed from tray 18.

When heavyweight papers, card stock or other rigid media 22 is used, performance of separator 50 is improved if separator 50 is allowed to move slightly when engaged by leading edges 78 of the more rigid media 22. FIG. 1 illustrates somewhat schematically a spring means allowing separator 50 to yield slightly if sufficient force is applied thereagainst by advancing media 22. Separator 50 slides generally along a plane parallel to surface 52, which is along the angle of inclination of separator 50.

Figure 3:
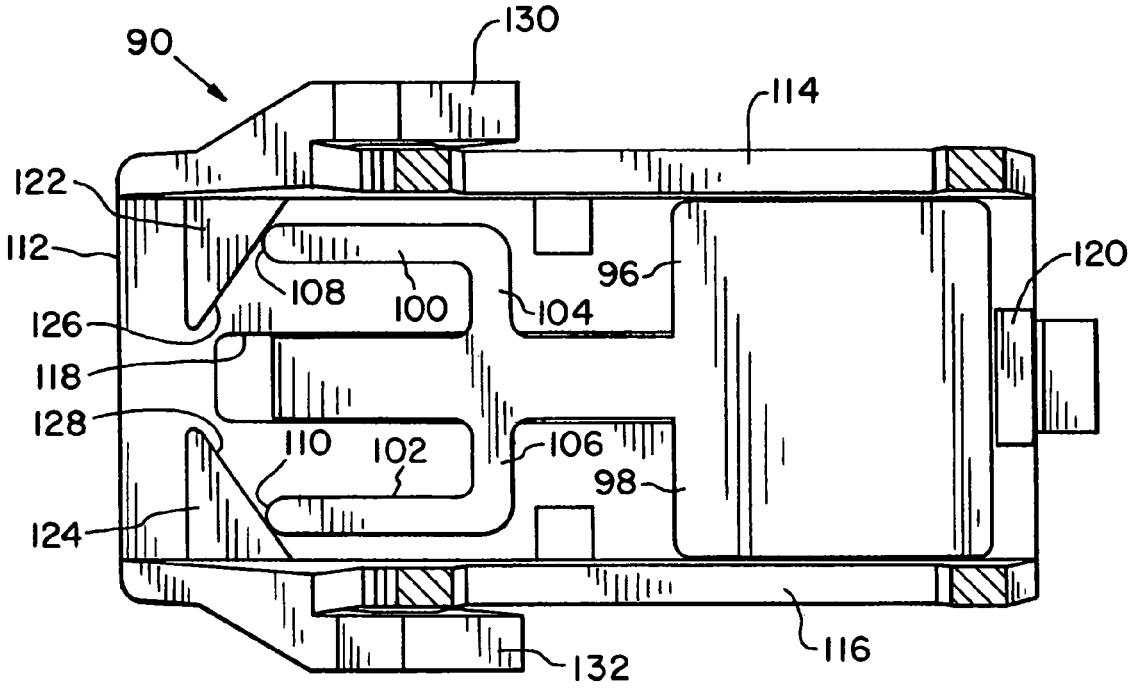
FIG. 3 is a plan view of a preferred assembly for a media separating device of the present invention, including a media separator and a holder therefor.
Figure 4:
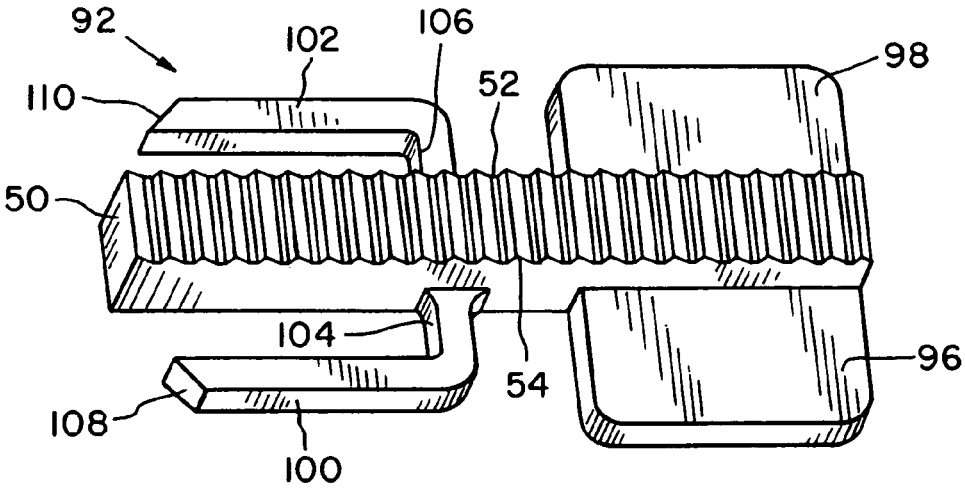
FIG. 4 is a perspective view of the media separator in the media separating device shown in FIG. 3.

A preferred assembly 90 for a media-separating device in accordance with the present invention is illustrated in FIG. 3. Assembly 90 includes a separator component 92 and a holder 94 therefor. Separator component 92, best seen in FIG. 4, can be provided as a monolithic structure of plastic or the like, and includes a separator 50 as described previously, including formations 54 thereon. Separator component 92 further includes lateral fins 96 and 98 at a lower end thereof, and arms 100 and 102 connected by shoulders 104 and 106, respectively, to separator 50. Shoulders 104 and 106 are connected to separator 50 at a center portion of separator 50, and extend outwardly from separator 50. Arms 100 and 102 extend from shoulders 104 and 106 toward an upper end of separator 50, substantially parallel to but spaced from separator 50. Arms 100, 102 and shoulders 104, 106 can deflect from force applied against the distal ends of arms 100 and 102. Tips 108 and 110 of arms 100 and 102, respectively, preferably are provided in curved (FIG. 3) or angled (FIG. 4) formations.

Figure 5:
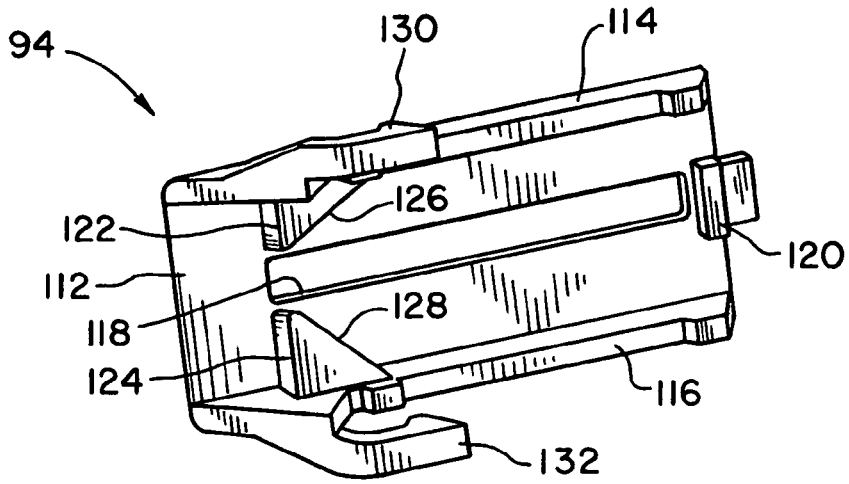
FIG. 5 is a perspective view of the holder for the media separator shown in FIG. 3.
Figure 6:
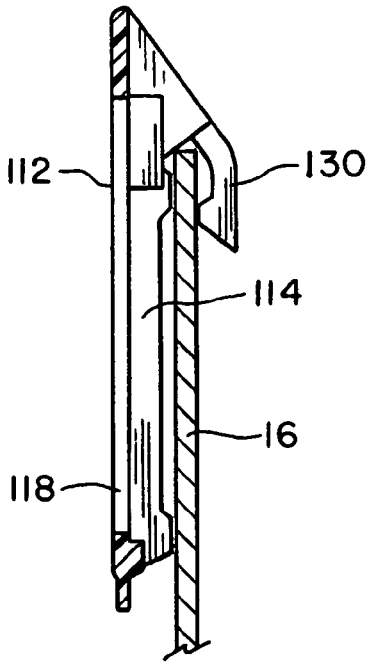
FIG. 6 is a cross-sectional view showing the holder attached to a component of a media feeder.

Holder 94, seen best in FIG. 5, is a somewhat box-like structure for holding and directing movement of separator component 92. Holder 94 has a panel 112 and sides 114 and 116 between which separator component 92 can slide. Panel 112 defines a slot 118 through which separator 50 projects. Slot 118 is longer than separator 50, allowing axial movement of separator 50 along and within slot 118. A stop 120 is provided on panel 112, near a lower end of slot 118. Angular blocks 122 and 124 are provided on panel 112 at an upper end thereof, just outwardly from slot 118. Surfaces 126 and 128 of blocks 122 and 124 extend angularly inwardly and upwardly from sides 114 and 116, respectively, toward the upper end of slot 118. Hooks 130 and 132 are provided on sides 114 and 116 for attaching holder 94 to a frame member 16 (FIG. 6), or to a portion of tray 18 at discharge end 24. Holder 94 is thus attached with separator component 92 held between panel 112 and frame member 16, and separator 50 projecting through slot 118.

In using assembly 90, force of rigid media 22 against separator 50 can cause separator component 92 to slide upwardly within holder 94. Fins 96 and 98 and arms 100 and 102 slide along panel 112 outwardly of slot 118, with separator 50 confined within slot 118. As separator component moves upwardly in holder 94, tips 108 and 110 of arms 100 and 102 engage surfaces 126 and 128 of blocks 122 and 124, respectively. The angular orientation of surfaces 126 and 128 causes arms 100 and 102 to deflect inwardly as separator component 92 moves farther from stop 120. The spring like affect resulting therefrom provides resistance to sliding by separator component 92, and returns separator component 92 to a lowest position against stop 120 when force against separator 50 is diminished or eliminated.

Figure 7:
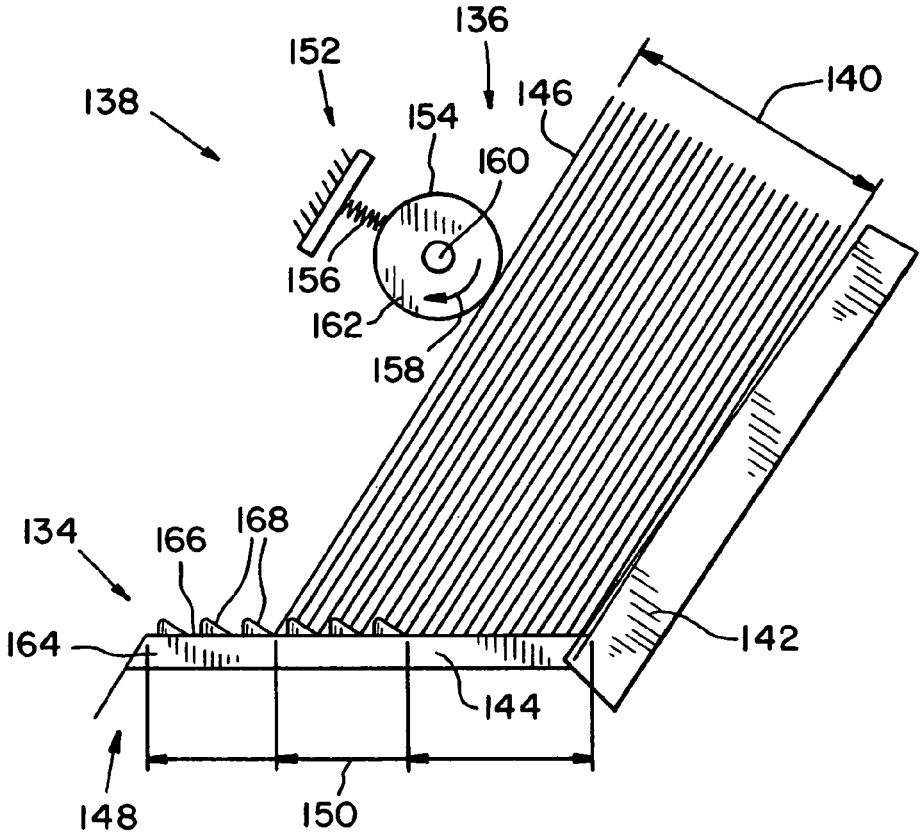
FIG. 7 is an elevational view of a passive media separating device in accordance with the present invention, shown for operation in a vertical media feeder.

FIG. 7 illustrates a passive media-separating device 134 of the present invention operating on a vertical media feeder 136 of a media-processing device 138. The embodiment illustrated in FIG. 7 is similar to that described previously herein, except that media feeder 136 illustrated in FIG. 7 is a vertical feeder having a substantially vertically oriented media stack 140 positioned against a substantially vertical support 142. A bottom 144 supports edges of some or all individual pieces of media 146 in stack 140. Individual pieces of media 146 are removed, one by one, from media stack 140 for use in downstream functions of media processing device 138. Media feeder 136 has a discharge side 148, and separating device 134 of the present invention is positioned along a bottom of media stack 140, between discharge side 148 and bottom 144. Some or all of media stack 140 can be positioned against a first length of separating device 134 indicated by line 150. As can be seen from FIG. 7, initial shingling of individual pieces of media 146 occurs along the first length of separating device 134 from the positioning of any portion of media stack 140 thereagainst.

Media feeder 136 further includes a feeding mechanism 152 including a feeding roll 154 that operates against media stack 140. Feeding roll 154 is biased by a spring 156 against stack 140. Feeding roll 154 is rotatably driven by drive means (not shown) to rotate in the direction indicated by arrow 158 about an axis 160. Feeding roll 154 is provided with a peripheral surface 162 of rubber, plastic or other material to creating sufficient friction between roll 154 and media 146 so that rotation of roll 154, together with the force of gravity, drives the outermost piece of media 146 toward discharge side 148.

Separating device 134 includes a separator 164 having a surface 166 facing media stack 140. Surface 166 has an array of formations 168 extending therealong to discharge side 148. Separating device 134 operates similarly to separating device 10, to cause progressively increasing shingling of media 146 being moved toward discharge side 148 by feeding mechanism 152.

Figure 8:
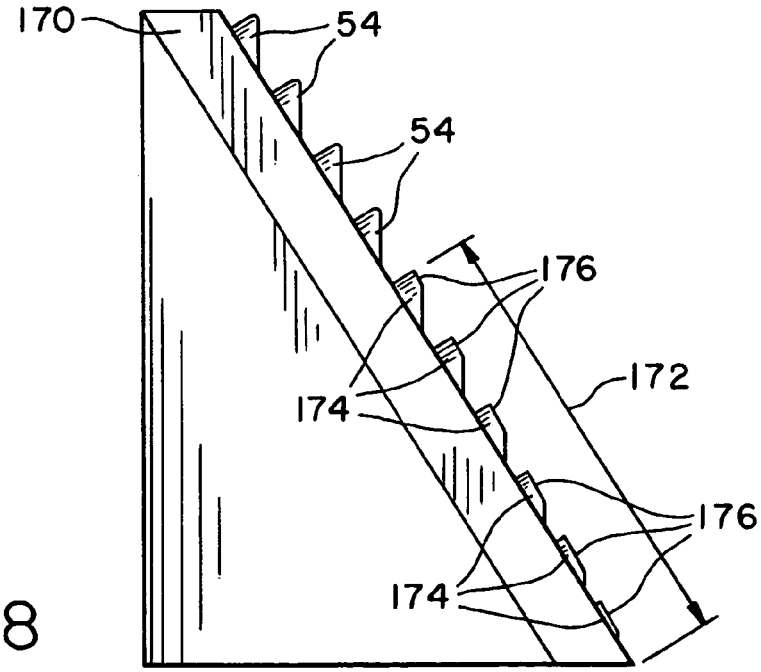
FIG. 8 is a side elevational view of the present passive media separating device, illustrating a modified form of the invention.

In a modified separator 170 (FIG. 8), formations 54 as described previously, are provided along an upper portion of separator 170, and along a lower portion thereof, designated by arrowed line 172, modified formations 174 are provided. Each formation 174 has a truncated apex 176, the truncations of which increase from the last of formations 54 toward the lower end of separator 170. Progressively increasing truncated apexes 176 promote removal and separation of media 22 at the lower end of media stack 20, where the force of engagement between feeding roll 30 and the uppermost piece of media 22 has lessened.

Figure 9:
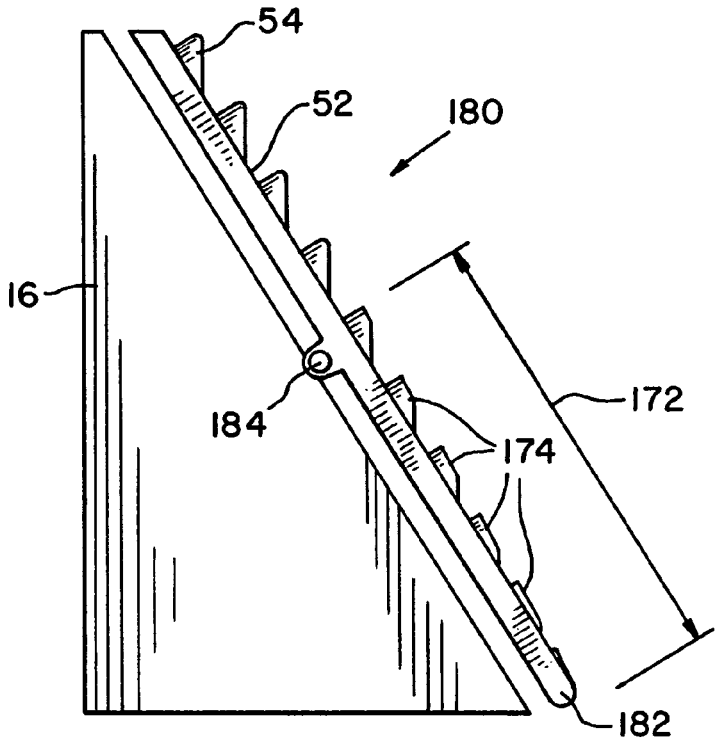
FIG. 9 is a side view similar to FIG. 8, but illustrating a further modification of the present invention.

In another variation of the present invention (FIG. 9), a media separating device 180 is provided with a pivotally mounted separator 182 having a surface 52 and projections 54 and 174 similar to those described previously herein. Separator 182 is connected to frame member 16 only by an axis 184 about which separator 182 can pivot. Spring means (not shown) can be provided along and associated with pivotal movement about axis 184, or between separator 182 and frame member 16.

Figure 10:
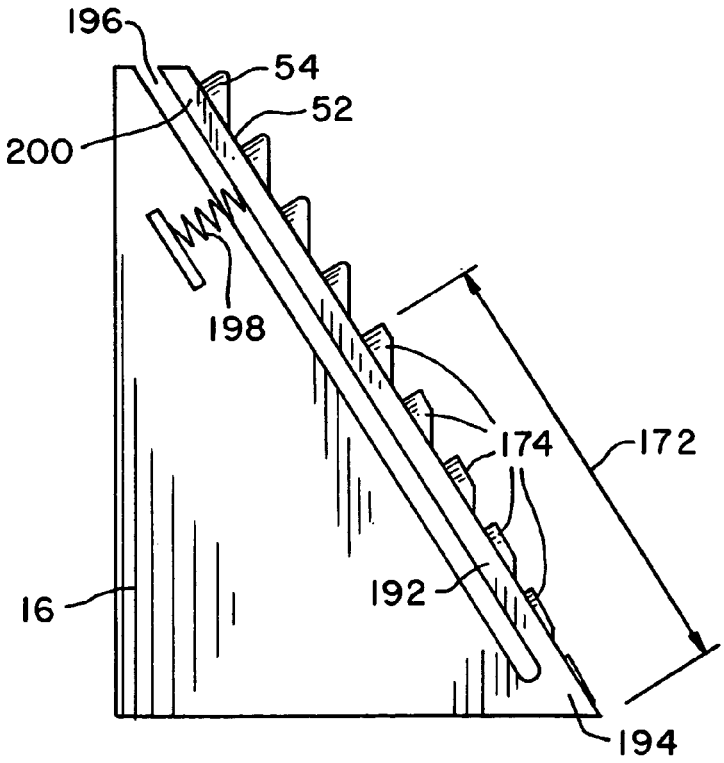
FIG. 10 is a side view similar to FIGS. 8 and 9, but illustrating still further modifications of the present invention.

In a further variation for providing springing resistance in the present invention (FIG. 10), a media separating device 190 is provided with a cantilevered separator 192 having a surface 52 and projections 54 and 174 similar to those described previously herein. Cantilevered separator 192 is connected to frame 16 at a lower end 194 of separator 192, but is otherwise unattached, defining a space 196 between frame 16 and separator 192. Springing deflection of separator 192 occurs at lower end 194. Further assistance can be provided with a spring 198 near distal end 200 of separator 192, to provide more robust resistance to deflection of cantilevered separator 192. Springs 198 of different spring force can be used, depending upon the types of media to be separated by separating device 190.

The present invention provides a media-separating device that works effectively for different types of media from the top piece of media in a media stack to the bottom piece of media in the stack. The device is mechanically simple, and can be provided inexpensively, for a variety of different feed mechanisms and media feeders. The blunt blocking surfaces of the separators provide abutments against which a stack of media can be placed, and thereby prevent heretofore experienced disadvantages of other separators in such conditions.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A media separating device for a media feeder in a media processing device wherein individual pieces of media are picked from a stack of media and advanced for individual handing in the media processing device, said separating device comprising:

a separator having a surface thereof disposed in a substantially confronting position relative to the stack of media to confront the leading edges of pieces of media removed from the stack;

an array of formations on said surface of said separator, each formation including;

a blocking surface positioned for confronting the leading edges of the moving media, causing the leading edges to deflect when abutted against said blocking surface;

a passing surface in a substantially non-confronting position relative to the leading edges of the media over which the media will slide; and an apex at a connection between said blocking and passing surfaces, said apex positioned relative to said passing surface and the movement of said leading edges for directing the leading edges over the passing surface, and such that the media does not contact the passing surface as it passes over the apex; and said array providing a succession of said formations along a path of travel by the leading edges of media removed from the stack; and means for driving pieces of media from the stack against the separator.

2. The media device of claim 1, said formations arranged in spaced relation along a length of said separator, exposing a segment of said separator surface between adjacent ones of said formations.

3. The media separating device of claim 1, said separator disposed at an angle of inclination upwardly and away from a base of the stack of media.

4. The media separating device of claim 3, said separator being movable along said angle of inclination, and being biased toward said base of the stack of media.

5. The media separating device of claim 3, said separator being cantilevered from said base of the stack of media.

6. The media separating device of claim 3, said separator having an upper end and a lower end and being pivotable about an axis between said upper and lower ends.

7. The media separating device of claim 3, said separator being cantilevered from said base of the stack of media, and said device including a spring exerting force against said separator.

8. The media separating device of claim 3, said formations including a first group of formations near said base having a first shape and a second group of formations near a distal end of said separator having a second shape different from said shape of said first group.

9. The media separating device of claim 8, said group of formations near said base having truncated apexes.

10. The media separating device of claim 1, said formations including a first group of formations first confronted by said leading edges and a second group of formations confronted thereafter, said formations of said first group having a shape different from a shape of formations of said second group.

11. The media separating device of claim 10, said first group of formations having truncated apexes.

12. The media separating device of claim 1, including a holder secured in said media feeder, and said separator being movably held by said holder.

13. The media separating device of claim 12, said holder defining a slot, and said formations projecting through said slot.

14. The media separating device of claim 13, said separator having shoulders extending outwardly from opposite sides thereof, and arms connected to said shoulders extending along and spaced from said separator.

15. A media separating device for a media feeder in a media processing device wherein individual pieces of media are picked from a stack of media and advanced for individual handing in the media processing device, said separating device comprising:

a separator having a surface thereof disposed in a substantially confronting position relative to the stack of media to confront the loading edges of pieces of media removed from the stack;

an array of formations on said surface of said separator, each formation including;

a blocking surface positioned for confronting the leading edges of the moving media, causing the leading edges to deflect when abutted against said blocking surface;

a passing surface in a substantially non-confronting position relative to the leading edges of the media over which the media will slide;

an apex at a connection between said blocking and passing surfaces, said apex positioned relative to said passing surface and the movement of said leading edges for directing the leading edges over the passing surface, said array providing a succession of said formations along a path of travel by the leading edges of media removed from the stack;

means for driving pieces of media from the stack against the separator; and a holder secured in said media feeder, said holder defining a slot and said formations projecting through said slot and said separator being movably held by said holder, said separator having shoulders extending outwardly from opposite sides thereof, and arms connected to said shoulders extending along and spaced from said separator, said holder having blocks with angled surfaces thereon, and said arms having tips abutting and sliding along said angled surfaces for deflecting said arm.

16. A media feeder for a media processing device, comprising:

a media tray for holding a stack of media, said media tray having a discharge point;

a feeding mechanism for moving a first piece of media from the stack toward the discharge point; and a media separating device including a surface facing leading edges of media in a stack of media held in the tray, said surface including a series of surface formations, each formation including;

a blocking surface positioned for confronting the leading edges of the moving media, causing the leading edges to deflect when abutted against said blocking surface;

a passing surface in a substantially non-confronting position relative to the leading edges of the media over which the media will slide; and an apex at a connection between said blocking and passing surfaces, said apex positioned relative to said passing surface and the movement of said leading edges for directing the leading edges over the passing surface such that the media does not contact the passing surface as it passes over the apex.

17. The media feeder of claim 16, said media separating device comprising an elongated separator disposed angularly, upwardly and outwardly from a bottom of the tray.

18. The media feeder of claim 17, said separator being spring biased toward said bottom.

19. The media feeder of claim 17, said separator having upper end and a lower end and defining a pivot between said upper end and said lower end; and said separator being pivotable about said pivot.

20. The media feeder of claim 17, said separator having an upper end and a lower end and being fixed at said lower end and being cantilevered from said lower end.

21. The media feeder of claim 16, said surface formations including a first group of formations near a bottom of said tray and a second group of formations, said formations of said second group each having a shape different from shapes of said formations in said first group.

22. The media feeder of claim 21, said formations of said first group having truncated apexes.

23. A media separating device assembly for a media feeder, said assembly comprising:

a separator holder including:

a panel defining a slot;

sides on opposite edges of said panel, said sides defining a path therebetween; and blocks on a surface of said panel, said blocks disposed on opposite sides of said slot near one end of said slot, each said block having an angular surface angling from one of said sides inwardly toward said slot and outwardly toward said one end; and a separator component slidable relative to said panel between said sides on opposite edges of the panel, said separator component including:

an elongated separator having an array of formations thereon, said elongated separator positioned in said slot with said formation projecting beyond an opposite surface of said panel;

arms connected to said elongated separator and extending along and spaced from said separator; and tips of said arms engaging said angular surfaces of said blocks.

24. The media separating device assembly of claim 23, said separator holder including a stop on said panel at an end of said slot opposite said one end of said slot.

25. The media separating device assembly of claim 23, said separator component including fins connected to said separator, said fins adapted for sliding on said panel.

26. The media separating device assembly of claim 23, said separator holder including hooks for attaching said separator holder to said media feeder.

* * * * *